US005327972A

United States Patent [19]

Theiss et al.

[11] Patent Number: 5,327,972

[45] Date of Patent: Jul. 12, 1994

[54] WELLHEAD SYSTEM

[75] Inventors: David H. Theiss, Houston; Joseph H. Hynes, Sugar Land, both of Tex.

[73] Assignee: Cooper Industries, Inc., Houston, Tex.

[21] Appl. No.: 951,487

[22] Filed: Sep. 25, 1992

[51] Int. Cl.[5] ..... E21B 23/02

[52] U.S. Cl. ..... 166/208; 166/237

[58] Field of Search ..... 166/208, 89, 115, 85, 166/382, 379

[56] References Cited

U.S. PATENT DOCUMENTS

| | | | |
|---|---|---|---|
| 2,916,092 | 12/1959 | Burns | 166/208 |
| 3,902,743 | 9/1975 | Martin | 166/208 X |
| 3,934,652 | 1/1976 | Cochran | 166/208 |
| 4,171,018 | 10/1979 | Walker | 166/208 |
| 4,181,331 | 1/1980 | Cowan | 166/208 |
| 4,562,889 | 1/1986 | Braddick | 166/208 |
| 4,577,686 | 3/1986 | Milberger et al. | 166/208 |
| 4,773,477 | 9/1988 | Putch | 166/208 X |
| 4,834,185 | 5/1989 | Braddick | 166/208 |
| 4,926,936 | 5/1990 | Braddick | 166/208 |

*Primary Examiner*—Ramon S. Britts
*Assistant Examiner*—Frank S. Tsay
*Attorney, Agent, or Firm*—Jackie Lee Duke; Eddie E. Scott; Alan E. Kopecki

[57] ABSTRACT

The improved wellhead system includes a wellhead housing with an internal annular shoulder having a plurality of removed arcs to form an interrupted support shoulder. A casing hanger is provided with an external annular shoulder having a plurality of removed arcs which correspond with those on the wellhead housing. In a first orientation, the removed arcs of the casing hanger shoulder align with the arcs of the support shoulder in the wellhead housing to allow the casing hanger to pass through the wellhead housing or the wellhead housing to be lowered below the casing hanger. In a second orientation the remaining shoulder arcs of the casing hanger align with the support shoulder arcs to support the casing hanger. The casing hanger also includes a thread for attaching a tool whereby the casing hanger and casing attached thereto can be tensioned. An alternate embodiment of the improved wellhead system includes a wellhead housing with an internal support groove. A casing hanger with a contractible split ring allows the casing hanger to be suspended from the internal support groove of the wellhead housing. A ring compression tool which allows the contractible split ring to be compressed allows selective engagement of the casing hanger with the internal support groove of the wellhead housing. This feature allows the casing hanger to pass through the wellhead housing or the wellhead housing to be installed over the casing hanger.

18 Claims, 8 Drawing Sheets

FIG. 11
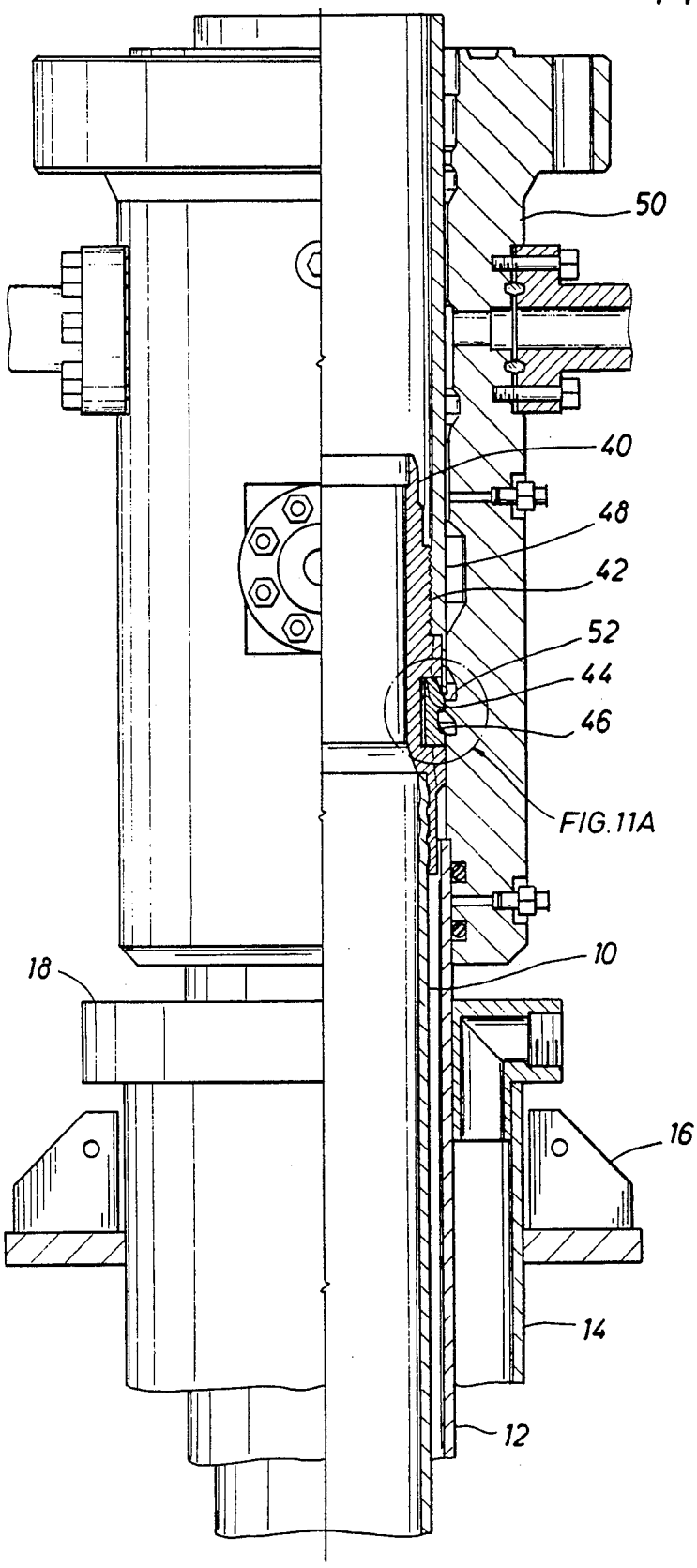
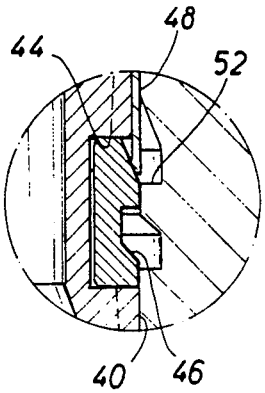
FIG. 11A

FIG. 12
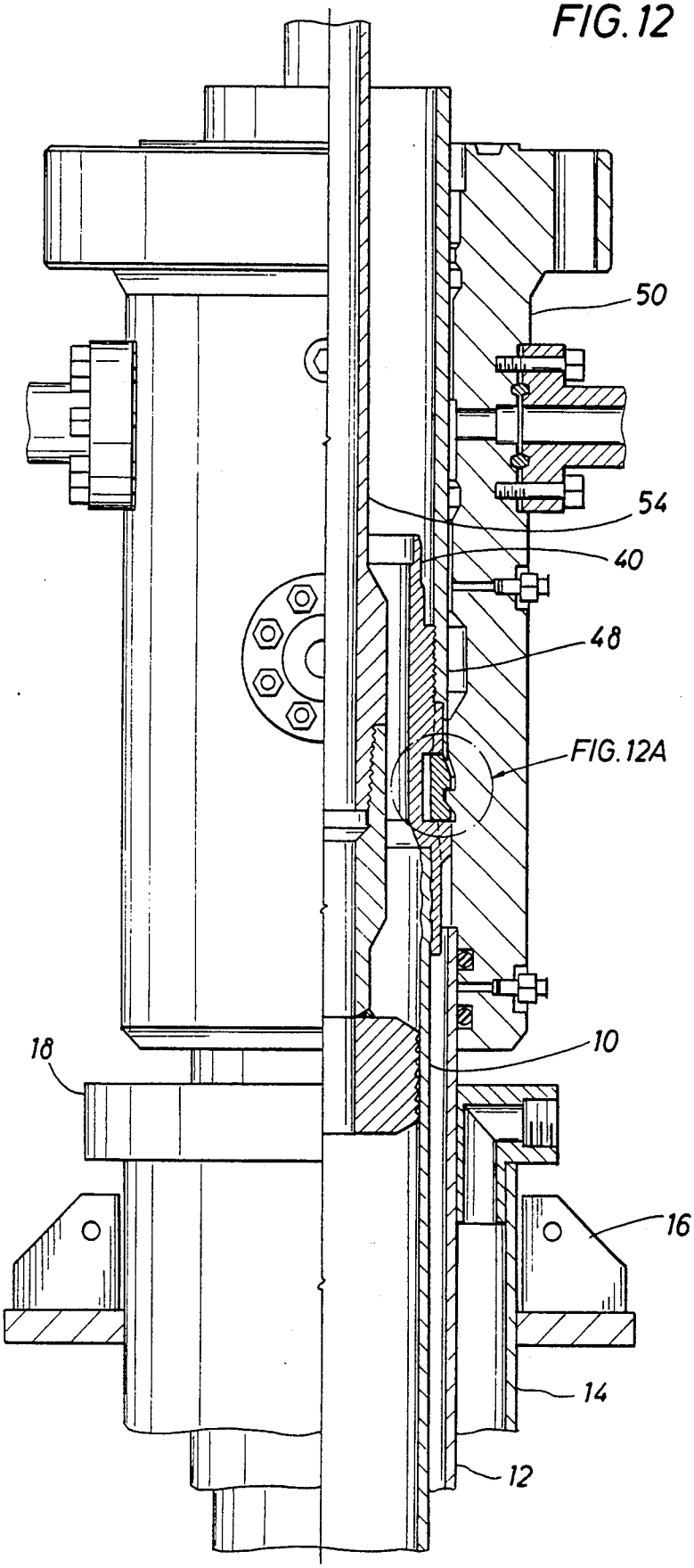
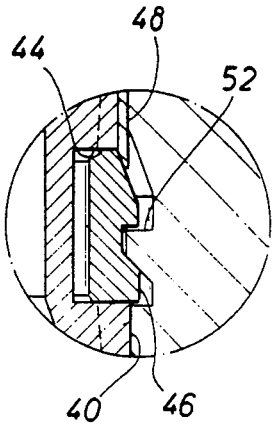
FIG. 12A

WELLHEAD SYSTEM

BACKGROUND

This invention relates to the field of wellhead apparatus, more particularly to wellhead housings and casing hangers which allow the wellhead housing to be installed over the casing hanger.

Prior wellhead systems are based on drilling the borehole of the well in successively smaller diameter sections and lining these sections with correspondingly smaller diameter sections of casing. Usually the wellhead housing is secured to the outermost string of casing and therefore the largest diameter casing lines the first section of the borehole of the well. The subsequent successively smaller diameter strings of casing are supported by casing hangers which sit on annular shoulders in the wellhead housing. Since the shoulders are machined in the wellhead housing, they limit the size of tools which can be passed through the wellhead housing. These dimensions and constraints do not allow the wellhead housing to be run after the casing hanger or the casing hanger to be run prior to the wellhead housing.

Prior oil and gas well completion operations in offshore locations often used a mudline wellhead positioned on the ocean floor with a few sections of casings, called a tie back string connected to a second wellhead located on a platform or similar structure. This type of completion required an adjustable sub to allow tensioning of the tie back string. The present invention eliminates the need for this adjustable sub by allowing the casing hanger to land below the landing shoulder in the wellhead housing. The tie back string is then tensioned by a tool connected to the casing hanger and the wellhead housing is then rotated to a position supporting the casing hanger.

In the event of the wellhead housing being damaged during drilling operations, previous wellhead systems prevented removal and replacement of the damaged wellhead housing due to the above-described configuration of the wellhead housing and the casing hangers. The improved wellhead system of the present invention overcomes the deficiencies of the prior art and provides a wellhead system which allows a wellhead housing to be installed over a previously installed casing hanger.

An example of a wellhead with a retractable seat is the D. L. Martin U. S. Pat. No. 3,902,743 which shows a radially movable split ring that provides a full opening through bore in its expanded position and a substantially continuous landing seat in its extended position.

The B. F. Baugh et al. U.S. Pat. No. 4,488,740 discloses a wellhead housing and a removable casing hanger support member with a plurality of circumferentially spaced breech block teeth disposed on each. The breech block teeth allow the wellhead housing to maintain a larger through bore with the casing hanger support member removed. Installation of the support member provides sufficient bearing area for the subsequent casing hangers.

SUMMARY

The improved wellhead system includes a wellhead housing with an internal annular shoulder having a plurality of removed arcs to form an interrupted support shoulder. A casing hanger is provided with an external annular shoulder having a plurality of removed arcs which correspond with those on the wellhead housing. In a first orientation, the removed arcs of the casing hanger shoulder align with the arcs of the support shoulder in the wellhead housing to allow the casing hanger to pass through the wellhead housing or the wellhead housing to be lowered below the casing hanger. In a second orientation the remaining shoulder arcs of the casing hanger align with the support shoulder arcs to support the casing hanger. The casing hanger also includes a thread for attaching a tool whereby the casing hanger and casing attached thereto can be tensioned. An alternate embodiment of the improved wellhead system includes a wellhead housing with an internal support groove. A casing hanger with a contractible split ring allows the casing hanger to be suspended from the internal support groove of the wellhead housing. A ring compression tool which allows the contractible split ring to be compressed allows selective engagement of the casing hanger with the internal support groove of the wellhead housing. This feature allows the casing hanger to pass through the wellhead housing or the wellhead housing to be installed over the casing hanger.

An object of the present invention is to provide an improved wellhead system which allows removal and replacement of a wellhead housing after installation of casing hangers within the wellhead housing.

Another object of the present invention is to provide an improved wellhead system which allows the spacing and tensioning of a tie back casing string from a mudline wellhead to a wellhead positioned on a platform or similar surface support structure.

BRIEF DESCRIPTION OF THE DRAWINGS

These and other objects and advantages of the present invention are set forth below and further made clear by reference to the drawings, wherein:

FIG. 11 is an elevation view, partly in section, showing the wellhead housing of the alternate embodiment installed over the casing hanger of FIG. 10 with the contractible ring of the casing hanger below the support groove of the wellhead housing.

FIG. 11A is an exploded view showing the details of the the contractible ring of the casing hanger and the support groove of the wellhead housing.

FIG. 12 is an elevation view, partly in section, showing a casing spear stretching the innermost casing string to allow the contractible ring of the casing hanger to engage the support groove of the wellhead housing.

FIG. 12A is an exploded view showing the contractible ring of the casing hanger engaging the support groove of the wellhead housing.

DESCRIPTION OF THE PREFERRED EMBODIMENT

Figure 1:
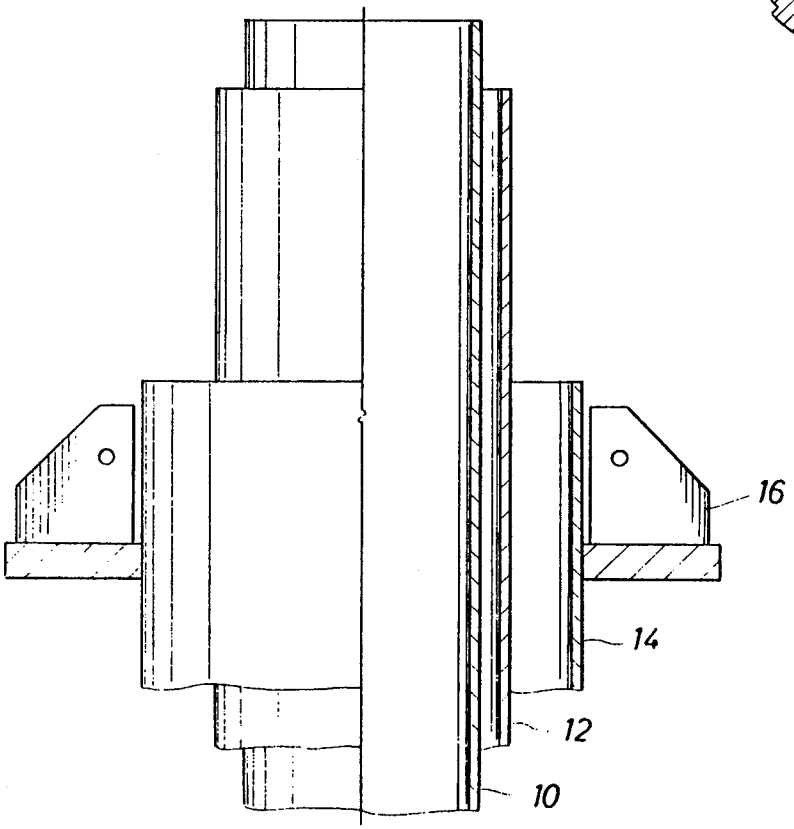
FIG. 1 is an elevation view, partly in section, of three casing strings terminating at a platform awaiting installation of a wellhead for completion.

With reference to FIG. 1, casing risers of 20", 13 ⅜" and 10 ¾", denoted by numerals 10, 12 and 14 respectively, extend from a mudline wellhead (not shown) to the platform structure 16. The lower ends of casing risers 10, 12 and 14 are connected to the mudline wellhead in a manner well known to those skilled in the art. Outer casing string 14 is connected to platform structure 16 by suitable means as welding.

Figure 2:
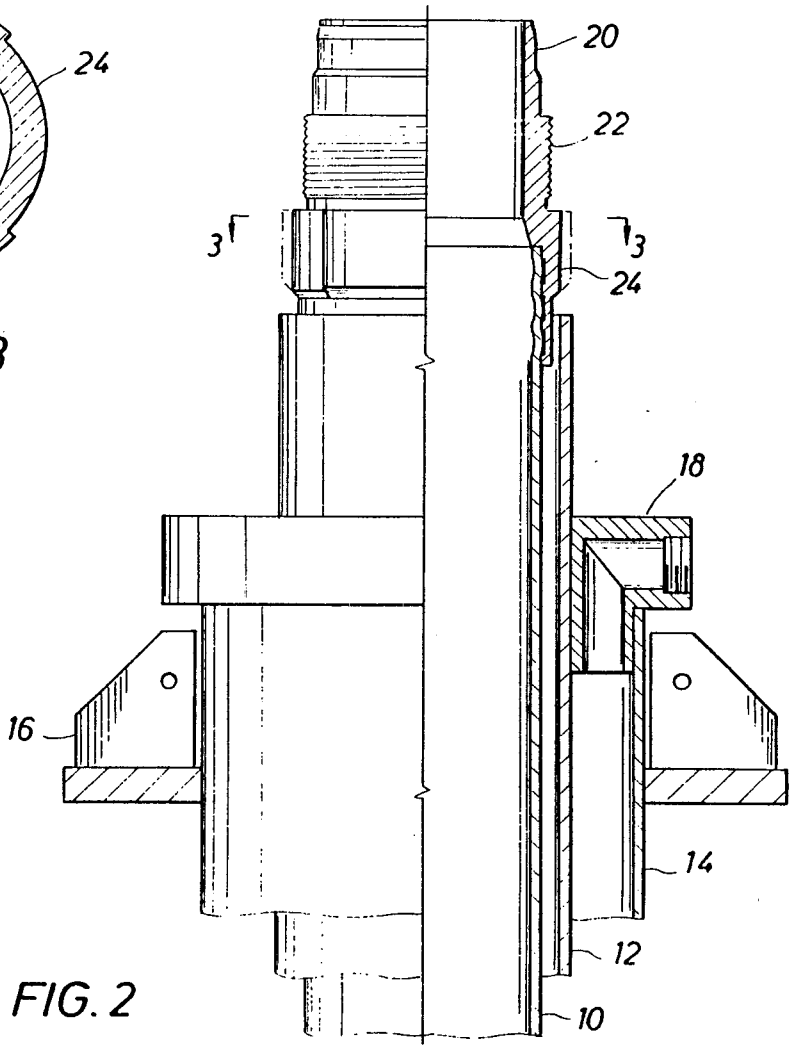
FIG. 2 is an elevation view, partly in section, showing a casing hanger installed on the innermost casing string of FIG. 1.
Figure 3:
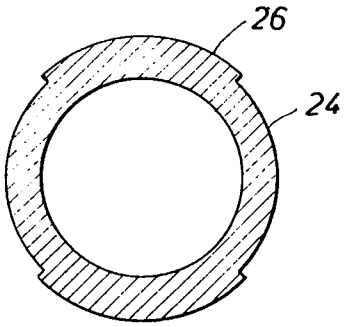
FIG. 3 is a cross-sectional view of the casing hanger of FIG. 2 taken along lines 3—3 showing the orientation of the casing hanger.

As best seen in FIG. 2, an optional annulus cap 18 is disposed in the 20"×13 ⅜" annulus and attached to casing risers 12 and 14 by suitable means as welding. Casing hanger 20 is connected to the upper end of casing riser 10 by suitable means as welding or cold forging. An external thread 22 is formed on the upper exterior of casing hanger 20 for purposes to be described hereinafter. The lower exterior of casing hanger 20 has annular support shoulder 24 formed thereon with portions removed to form support shoulder arcs 26 as best seen in FIG. 3.

Figure 4:
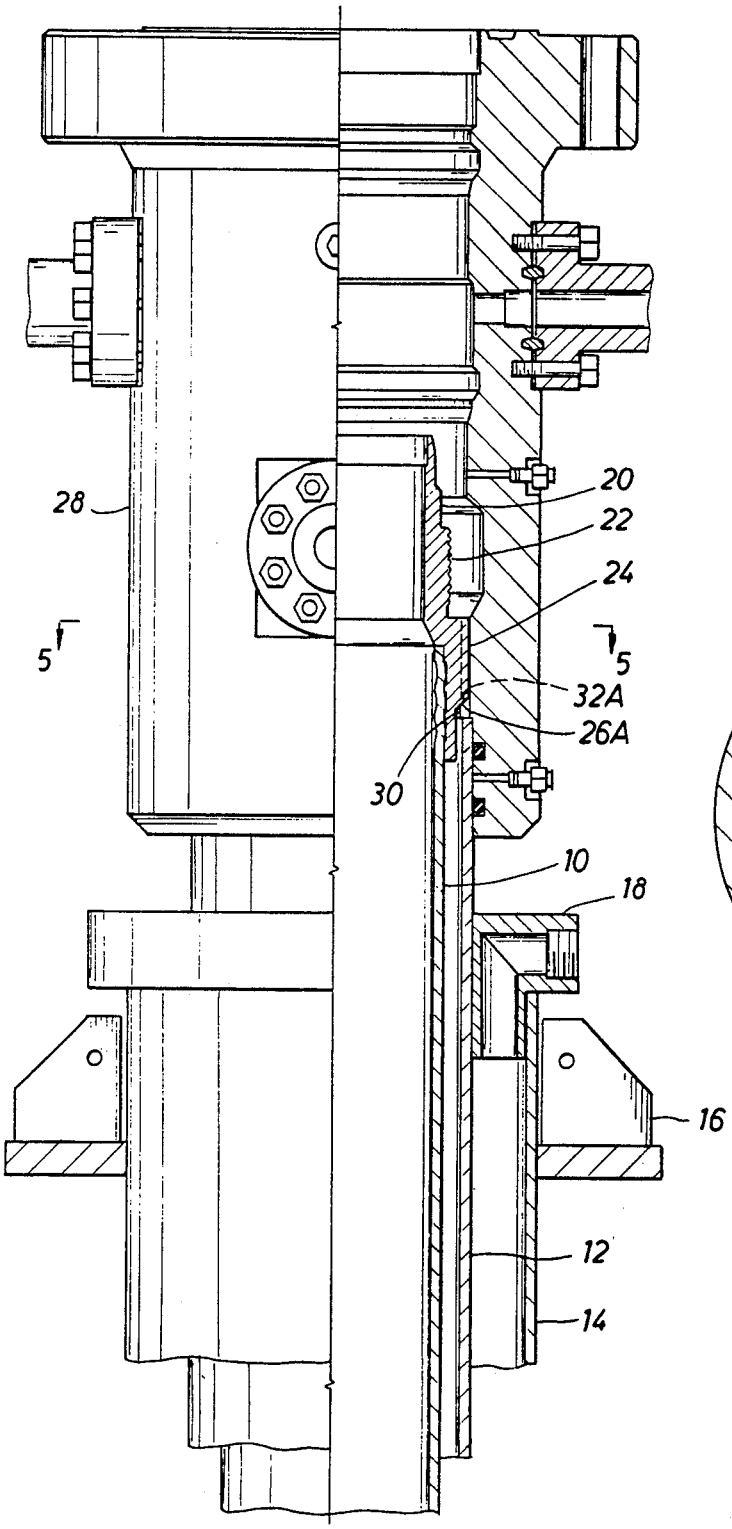
FIG. 4 is an elevation view, partly in section, showing the wellhead housing installed over the casing hanger of FIG. 2 with the casing hanger below the support shoulder of the wellhead housing.
Figure 5:
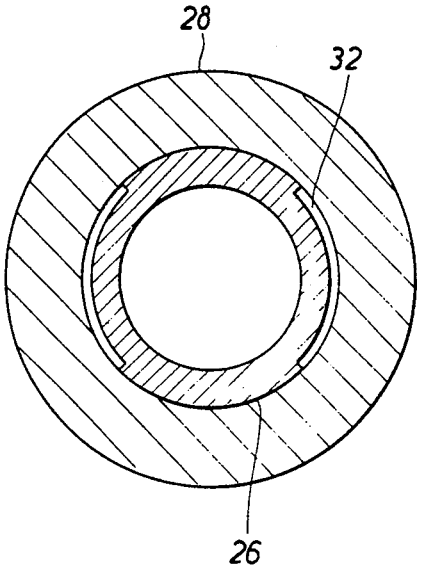
FIG. 5 is a cross-sectional view of the casing hanger of FIG. 4 taken along lines 5—5 showing the orientation of the landing shoulder of the casing hanger and the landing shoulder of the wellhead housing.
Figure 6:
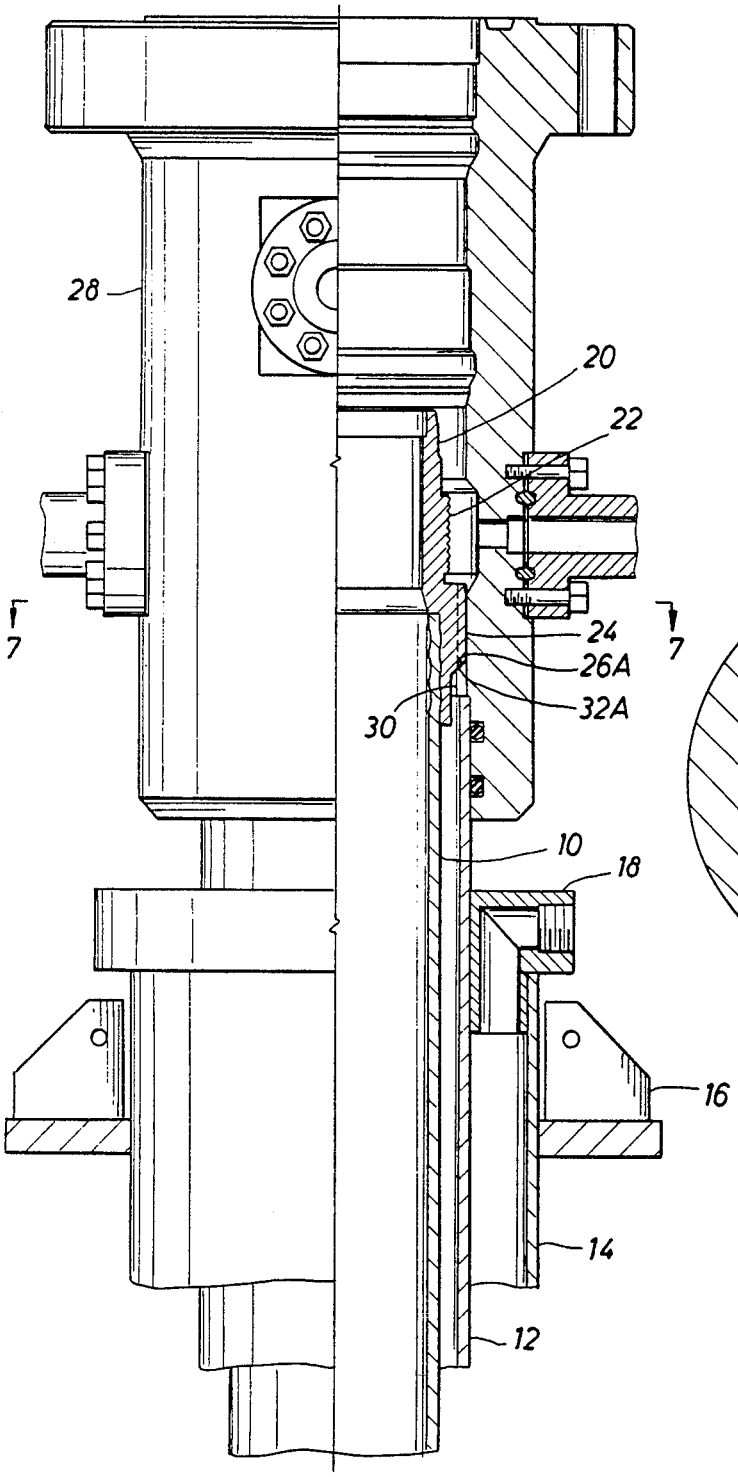
FIG. 6 is an elevation view, partly in section, showing the wellhead housing rotated 90° from the position of FIG. 4 with the landing shoulder of the casing hanger seated on the landing shoulder of the wellhead housing.
Figure 7:
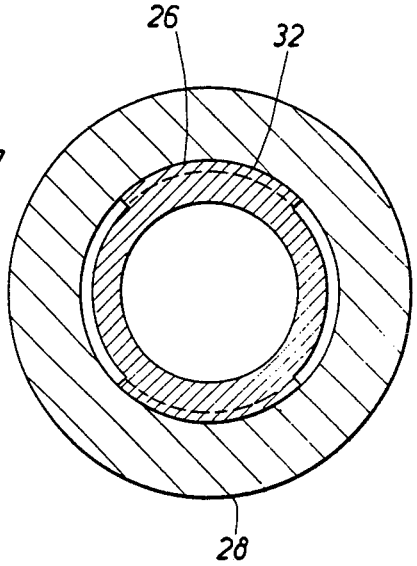
FIG. 7 is a cross-sectional view of the casing hanger of FIG. 6 taken along lines 7—7 showing the orientation of the landing shoulder of the casing hanger and the landing shoulder of the wellhead housing.
Figure 8:
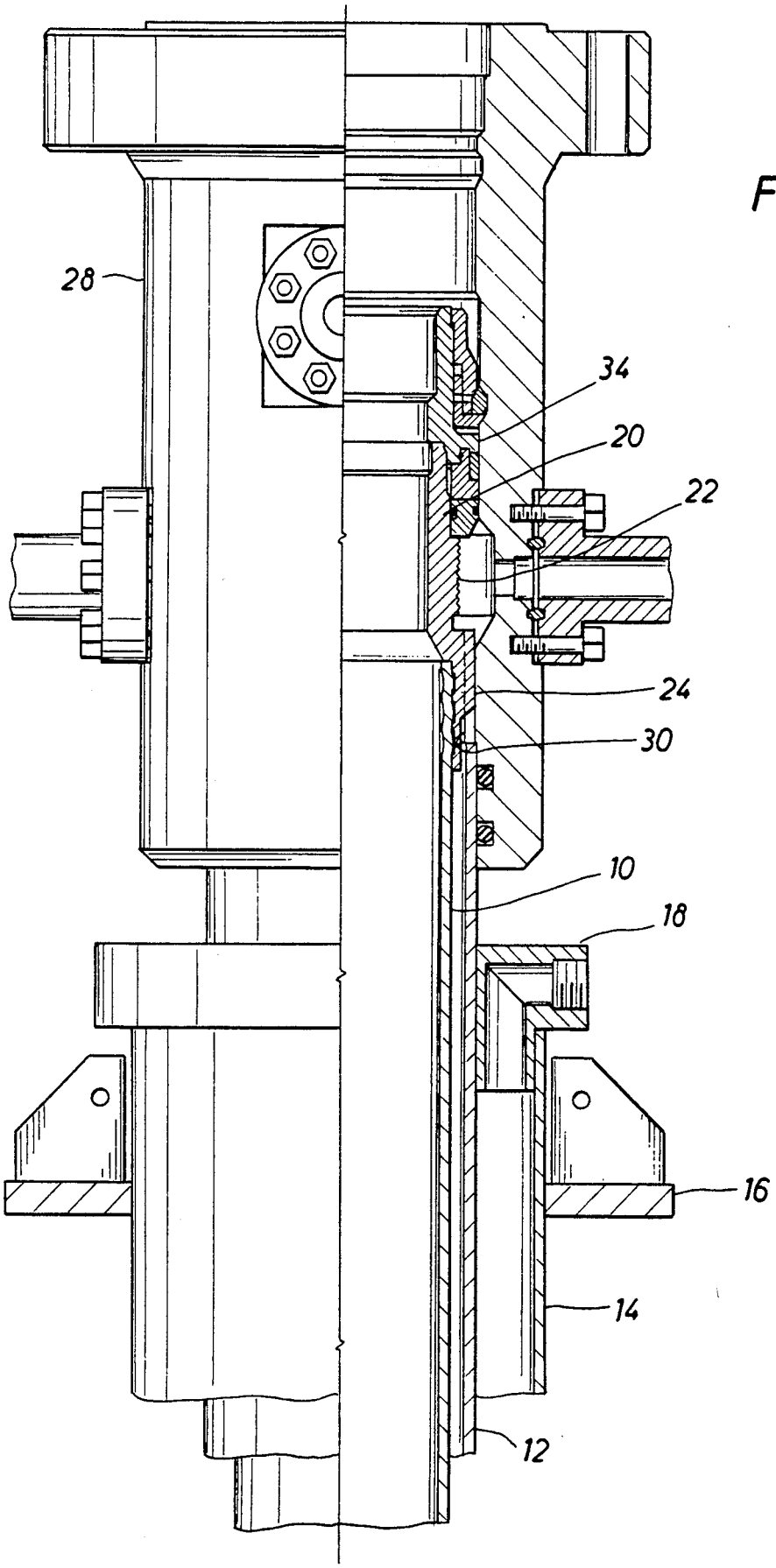
FIG. 8 is an elevation view, partly in section, showing an annulus packoff installed in the wellhead housing of FIG. 6.

Referring to FIG. 4, wellhead housing 28 is located on the upper end of casing riser 12 and attached thereto by suitable means as welding. Support shoulder 30 is formed on the interior of wellhead housing 28 with portions removed to form support shoulder arcs 32 as best seen in FIG. 5. As shown in FIG. 4, support shoulder arcs 26 on casing hanger 20 are disposed between and below support shoulder arcs 32 on wellhead housing 28. A casing tensioning tool (not shown) is attached to thread 22 of casing hanger 20 and casing 10 is tensioned sufficiently to allow wellhead housing 28 to be rotated 90° to the position shown in FIGS. 6 and 7 The tension on casing 10 is released and support shoulder arcs 26 of casing hanger 20 rest on support surfaces 32A defined by the support shoulder arcs 32 of wellhead housing 28 to support casing 10 in tension. Annulus packoff 34 is then installed as shown in FIG. 8 and completion of the well can continue in a manner well known to those skilled in the art.

In the event of wellhead housing 28 being damaged during subsequent completion operations, the above-described sequence of operations can be reversed to allow installation of a new undamaged wellhead. Annulus packoff 34 is first removed and the casing tensioning tool is reattached to thread 22 of casing hanger 20. Sufficient tension is applied to stretch casing 10, thereby lifting support shoulder arcs 26 off support shoulder arcs 32 and allowing wellhead housing 28 to be rotated to the position shown in FIGS. 4 and 5. Wellhead housing 28 can then be stripped over casing hanger 20 and a replacement wellhead housing installed as previously described.

Figure 9:
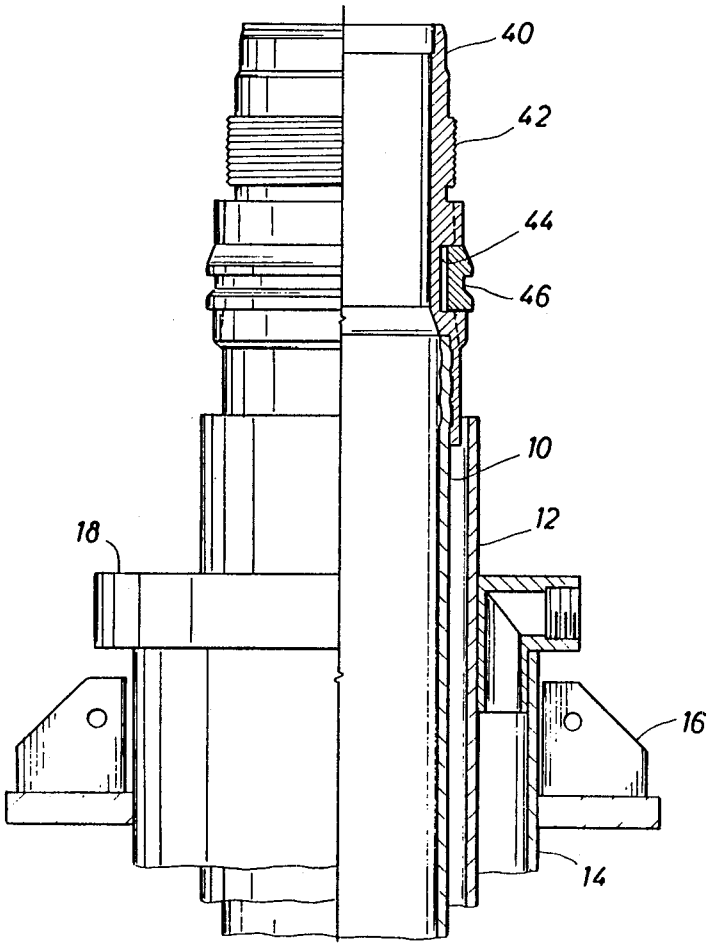
FIG. 9 is an elevation view, partly in section, of an alternate embodiment showing a casing hanger installed on the innermost casing string of FIG. 1.

FIG. 9 shows an alternate embodiment of the improved wellhead system. Those items which are unchanged from the preferred embodiment carry the same numeral designation. As in the preferred embodiment, casing risers of 20", 13 ⅜" and 10 ¾", denoted by numerals 10, 12 and 14 respectively, extend from a mudline wellhead (not shown) to the platform structure 16. The lower end of casing risers 10, 12 and 14 are connected to a mudline wellhead (not shown) in a manner well known to those skilled in the art. Outer casing string 14 is connected to platform structure 16 by suitable means as welding.

Optional annulus cap 18 is disposed in the 20"×13 ⅜" annulus and attached to casing risers 12 and 14 by suitable means as welding. Casing hanger 40 is connected to the upper end of casing riser 10 by suitable means as welding or cold forging. An external thread 42 is formed on the upper exterior of casing hanger 40 for purposes to be described hereinafter. The lower exterior of casing hanger 40 has annular groove 44 formed thereon with radially contractible split ring 46 positioned thereon. Casing hanger 40 is connected to the upper end of casing riser 10 by suitable means as welding or cold forging.

Figure 10:
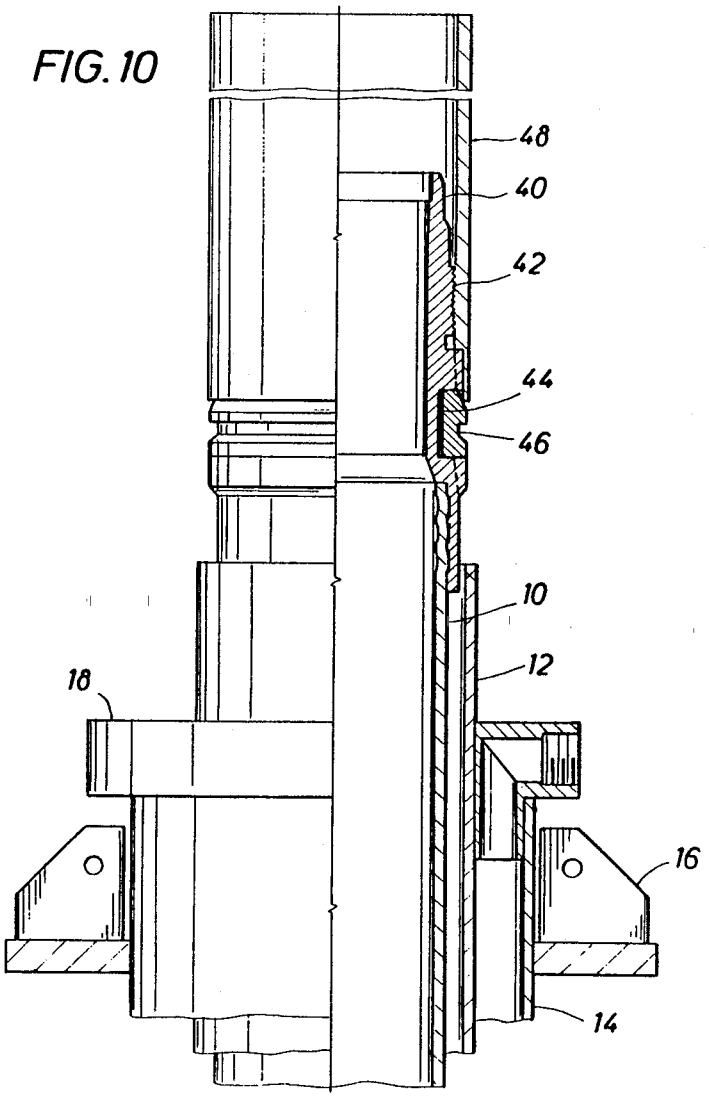
FIG. 10 is an elevation view, partly in section, of a ring compression tool holding the contractible split ring in its retracted position.

Ring compression tool 48 is threaded onto thread 42 of casing hanger 40 until split ring 46 is in the compressed position shown in FIG. 10. Referring to FIG. 11, wellhead housing 50 is positioned on the upper end of casing riser 12 with support groove 52 positioned therein. Initially split ring 46 is positioned below support groove 52 as seen in FIG. 11A.

Figure 13:
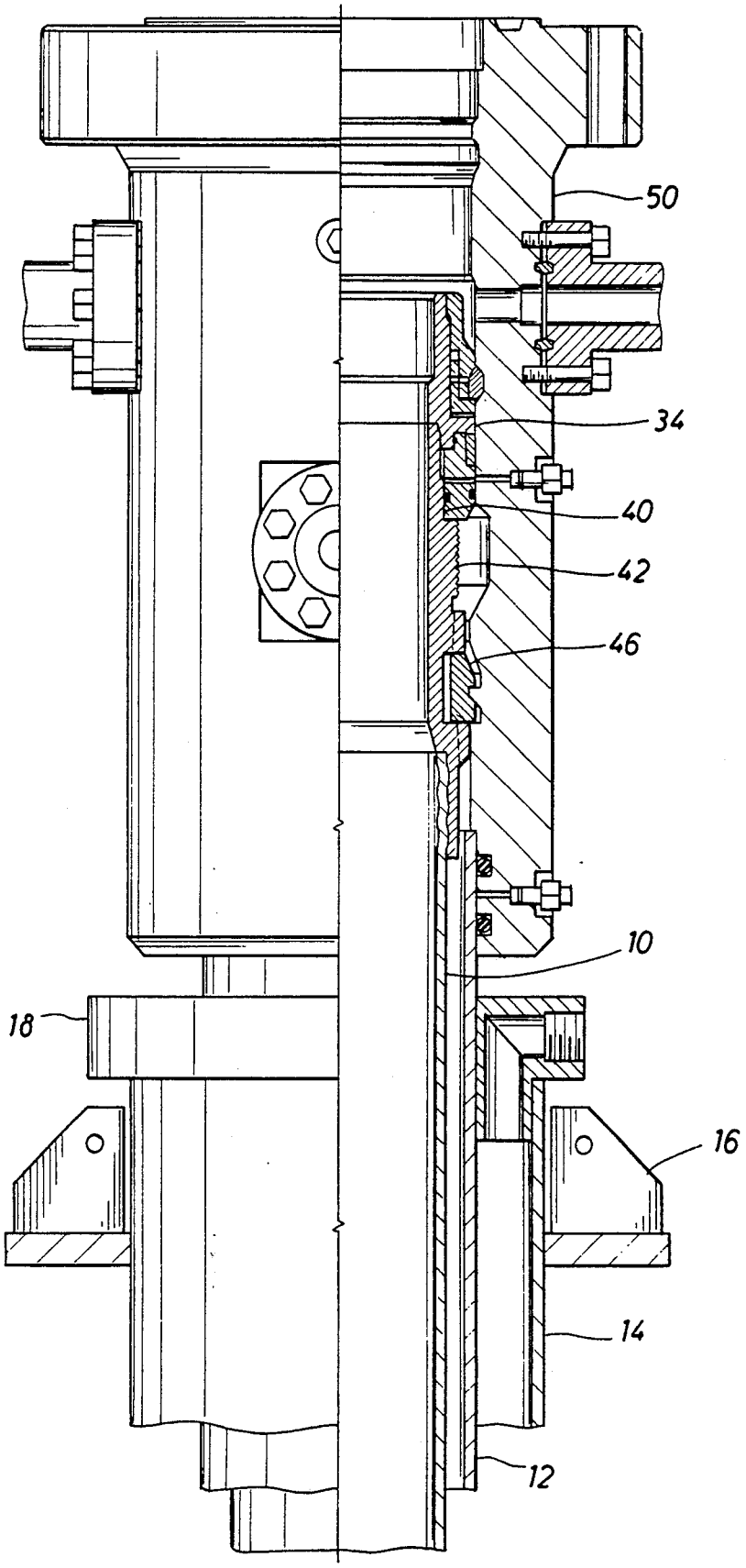
FIG. 13 is an elevation view, partly in section, showing an annulus packoff installed in the wellhead housing of FIG. 12.

Ring compression tool 48 is partially unthreaded from thread 42 of casing hanger 40 to allow split ring 46 to expand. Tension is then applied to ring compression tool 48 and casing hanger 40 until casing 10 is tensioned sufficiently to allow split ring 46 to engage support groove 52 as seen in detail in FIG. 12A. Alternatively, as best seen in FIG. 12, a casing spear 54 is landed in the interior of casing 10 and casing 10 is tensioned sufficiently to allow compression ring tool 48 to be unthreaded and split ring 46 to engage support groove 52 as seen in detail in FIG. 12A. The tension on casing 10 is released and split ring 46 rests on support groove 52 of wellhead housing 50 to support casing 10 in tension. Annulus packoff 34 in then installed as shown in FIG. 13 and completion of the well can continue in a manner well known to those skilled in the art.

In the event of wellhead housing 50 being damaged during subsequent completion operations, the above-described sequence of operations can be reversed to allow installation of a new undamaged wellhead. Annulus packoff 34 is first removed and the casing spear 54 is reattached to the interior of casing 10. Sufficient tension is applied to stretch casing 10, thereby lifting split ring 46 off support groove 52. Ring compression tool 48 is then threaded onto thread 42 and split ring 46 is compressed, allowing wellhead housing 50 to be stripped over casing hanger 40 and a replacement wellhead housing installed as previously described.

The construction of our improved wellhead system and the methods of its application will be readily understood from the foregoing description and it will be seen we have provided an improved wellhead system which allows the installation of a wellhead housing after installation of casing hangers within the wellhead housing. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A wellhead system for supporting a plurality of casings in an oil or gas well, comprising:

a wellhead housing, a casing hanger, a means for selectively supporting said casing hanger within said wellhead housing, said selective supporting means allowing said casing hanger to pass through said wellhead housing in a first orientation, and said selective supporting means allowing said casing hanger to be supported within said wellhead housing in a second orientation, wherein said selective supporting means includes:

a shoulder within said wellhead housing having a plurality of circumferentially spaced support shoulder arcs, a shoulder on said casing hanger having a plurality of circumferentially spaced support shoulder arcs, whereby said support shoulder arcs within said wellhead housing and said support shoulder arcs on said casing hanger cooperate to allow said casing hanger to pass through said wellhead housing in said first orientation.

2. A wellhead system according to claim 1 wherein:

said support shoulder arcs within said wellhead housing and said support shoulder arcs on said casing hanger cooperate to allow said wellhead housing to support casing hanger in said second orientation.

3. A wellhead system according to claim 2 wherein:

said support shoulder arcs within said wellhead housing and said support shoulder arcs on said casing hanger are equally spaced circumferentially.

4. A wellhead system for supporting a plurality of casings in an oil or gas well, comprising:

a wellhead housing having an outer casing string secured thereto, a casing hanger having an inner casing string secured thereto, a shoulder within said wellhead housing having a plurality of circumferentially spaced support shoulder arcs, a shoulder on said casing hanger having a plurality of circumferentially spaced support shoulder arcs, whereby said support shoulder arcs within said wellhead housing and said support shoulder arcs on said casing hanger cooperate to allow said casing hanger support shoulder arcs to be positioned below the wellhead housing support shoulder arcs in a first orientation.

5. A wellhead system according to claim 4 wherein:

said casing hanger includes a tensioning means whereby said inner casing string may be tensioned to allow said support shoulder arcs on said casing hanger to be supported on said support shoulder arcs within said wellhead housing in a second orientation.

6. A wellhead system according to claim 5 wherein:

said support shoulder arcs within said wellhead housing and said support shoulder arcs on said casing hanger are equally spaced circumferentially.

7. A wellhead system for supporting a plurality of casings in an oil or gas well, comprising:

a wellhead housing having an outer casing string secured thereto, a casing hanger having an inner casing string secured thereto, a support groove within said wellhead housing, a contractible split ring on said casing hanger, said support groove within said wellhead housing and said contractible split ring on said casing hanger cooperating to allow said casing hanger split ring to be supported on said wellhead housing support groove after said inner casing string is tensioned.

8. A wellhead system according to claim 7 including:

a ring compression tool, said ring compression tool contracting said contractible split ring to allow selective engagement of said contractible split ring with said wellhead housing support groove.

9. A wellhead system for supporting a plurality of casings in an oil or gas well allowing installation of a wellhead housing over a previously installed casing hanger and connection to an outer casing string, comprising:

a casing hanger having an inner casing string secured thereto, a wellhead housing sized to fit said outer casing string, a shoulder within said wellhead housing having a plurality of circumferentially spaced support shoulder arcs, a shoulder on said casing hanger having a plurality of circumferentially spaced support shoulder arcs, and whereby said support shoulder arcs within said wellhead housing and said support shoulder arcs on said casing hanger cooperate to allow said casing hanger support shoulder arcs to be positioned below the wellhead housing support shoulder arcs when said wellhead housing is installed on said outer casing string.

10. A wellhead system according to claim 9 wherein:

said casing hanger includes a tensioning means whereby said inner casing string may be tensioned to allow said support shoulder arcs on said casing hanger to be supported on said support shoulder arcs within said wellhead housing.

11. A wellhead system according to claim 10 wherein:

said support shoulder arcs within said wellhead housing and said support shoulder arcs on said casing hanger are equally spaced circumferentially.

12. A wellhead system for supporting a plurality of casings in a oil or gas well allowing installation of a wellhead housing over a previously installed casing hanger and connection to an outer casing string, comprising:

a casing hanger having an inner casing string secured thereto, a wellhead housing sized to fit said outer casing string and positioned around an outer circumference of said casing hanger, a support groove formed on an inner circumference of said wellhead housing, a contractible split ring mounted on said outer circumference of said casing hanger, and said support groove within said wellhead housing and said contractible split ring on said casing hanger cooperating to allow said casing hanger split ring to be supported on said wellhead housing support groove after said inner casing string is tensioned.

13. A wellhead system according to claim 12 including:

a ring compression tool, said ring compression tool sized to be inserted between said wellhead housing and said casing hanger for contracting said contractible split ring to allow selective engagement of said contractible split ring with said wellhead housing support groove.

14. A wellhead system according to claim 12, wherein said casing hanger includes an external screw thread disposed above said split ring to be connected to a ring compression tool for contracting said split ring radially inwardly.

15. A wellhead system for supporting a plurality of casings in an oil or gas well, comprising:

a wellhead housing defining a longitudinal axis and having first support surface means;

a casing hanger disposable coaxially within said wellhead housing and having second support surface means;

said wellhead housing and said casing hanger being relatively movable between first and second relative orientations, such that when said wellhead housing and casing hanger are in said first relative orientation, said first and second support surface means are out of axial alignment to permit said wellhead housing to travel axially past said casing hanger, and such that when said wellhead housing and said casing hanger are in said second relative orientation, said second support surface means is in axial alignment with said first support surface means and disposed therebeneath for supporting said casing hanger on said wellhead housing.

16. A wellhead system according to claim 15, wherein said first and second support surface means are spaced apart circumferentially about said axis when said wellhead housing and said casing hanger are in said first relative orientation.

17. A wellhead system according to claim 16, wherein said wellhead housing and said casing hanger are relatively rotatable about said axis between said first and second relative orientations.

18. A wellhead system according to claim 15 including outer and inner casing strings, said wellhead housing being attached to said outer casing string adjacent an upper end thereof, said casing hanger being attached to said inner casing string adjacent an upper end thereof.

* * * * *